United States Patent [19]

Sälzer

[11] Patent Number: 4,741,277

[45] Date of Patent: May 3, 1988

[54] DOOR OR WINDOW

[76] Inventor: Heinrich Sälzer, Industriestrasse 4, 3550 Marburg-Wehrda, Fed. Rep. of Germany

[21] Appl. No.: 4,913

[22] Filed: Jan. 20, 1987

[30] Foreign Application Priority Data

Jan. 25, 1986 [DE] Fed. Rep. of Germany ..... 3602218

[51] Int. Cl.[4] ..... E06B 1/04

[52] U.S. Cl. ..... 109/77; 109/74; 109/26

[58] Field of Search ..... 109/65, 74, 75, 76, 109/77, 64, 58, 9, 49.5, 85, 79; 49/504, 505

[56] References Cited

U.S. PATENT DOCUMENTS

| | | | |
|---|---|---|---|
| 548,446 | 10/1895 | Mosler | 109/77 |
| 1,428,340 | 9/1922 | Meilink | 109/74 |
| 1,547,717 | 7/1925 | Bartels | 109/75 |
| 1,616,249 | 2/1927 | Bartels | 109/75 |
| 2,681,018 | 6/1954 | McCella | 109/74 |
| 4,598,647 | 7/1986 | Biedess | 109/74 |

FOREIGN PATENT DOCUMENTS 2818745 11/1979 Fed. Rep. of Germany .

OTHER PUBLICATIONS

Pamphlet submitted by applicant–"Sichere Türen Fenster und Wandelemente", Aug. 1982.

*Primary Examiner*—Robert L. Wolfe
*Attorney, Agent, or Firm*—Arthur B. Colvin

[57] ABSTRACT

On an attack-endangered side of members (1, 6) of a fixed frame and a sash frame mounted swingably therein, respective bombardment-inhibiting profiles (11, 12) with overlapping edge margins (11', 12') are provided. In the overlap region these safety profiles (11, 12) define a gap (13). Since the edge surfaces of the bombardment-inhibiting profiles (11, 12) which define the gap (13) are formed with respective ridges (4, 17) and grooves (15, 16) intermeshed with one another, the gap course is sinusoidal. This offers a high degree of security against shoot-through and break-in in the gap region of the door or of the window.

4 Claims, 1 Drawing Sheet

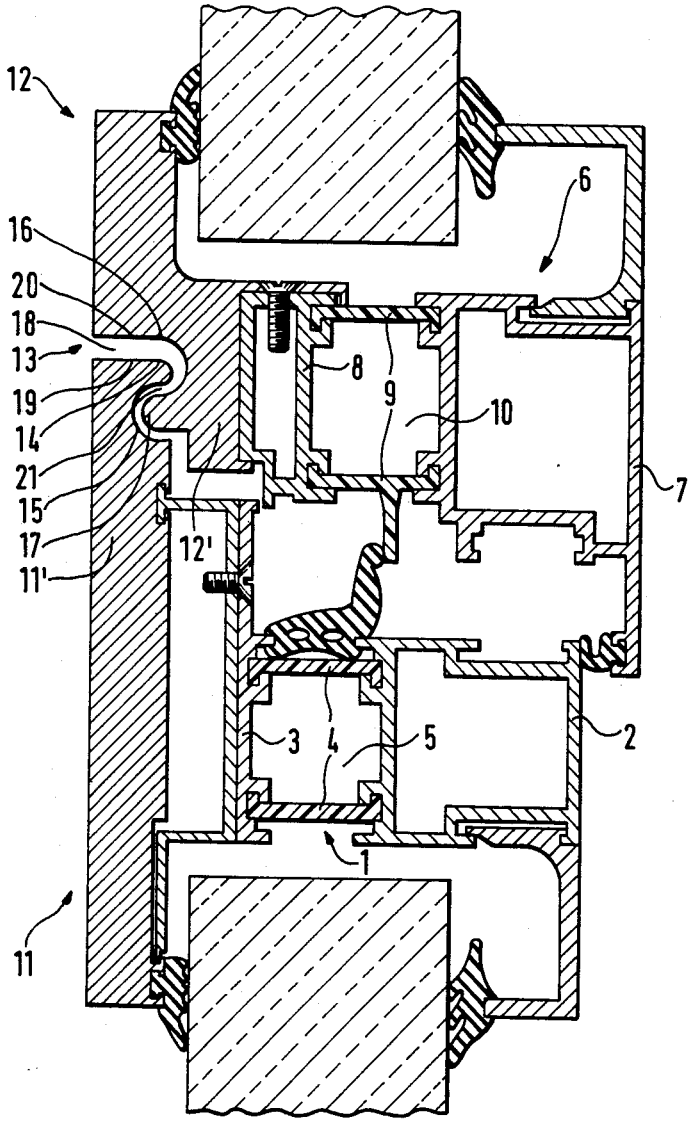
12
16
20
18
13
19
14
21
15
17
11'
12'
8
9
10
6
7
3
4
5
2
1
11

DOOR OR WINDOW

This invention relates to a door or a window having a fixed frame and a swingably-mounted sash frame arranged therein. Inserted in the sash frame is a safety pane the edge regions of which are masked by bombardment-inhibiting profiles of the sash frame. These overlap with bombardment-inhibiting profiles of the fixed frame. For unimpeded operation of the sash frame, however, a gap must remain between the respective profiles in the overlap region.

In known constructions fo this kind, the gap between the safety profiles of the sash frame and of the fixed frame represents a weak point, because there is a danger that projectiles from small firearms or larger firearms, including submachine guns can penetrate into the room that is protected by the door or window by way of this gap. There is also a danger that housebreaking tools can be used to penetrate into the gap, and thereby break open the entire construction.

To diminish such risks a bombardment-inhibiting aluminum window has already been proposed in German Patent Specification No. DE-PS 28 18 745 wherein bombardment-inhibiting plates made from an aluminum alloy are glued or welded onto the outside or inside of the aluminum profiles of the sash frame and of the casement frame. In the region of the gap between the sash frame and the basement frame these bombardment-inhibiting plates are designed in such a way that either from the gap to the outside of the bombardment-inhibiting plate an opening, extending at an angle of 45° to the window plane, in the width of the gap remains or that in the width of the gap a rebate is provided which is offset at right angles at the height of the centre of the bombardment-inhibiting plates. In this way a gap which in a plan perpendicular to the door or window plane remains in the overlap region changes its directions more than once.

The known construction has the disadvantage that, at best, it only reduces the risk of shooting through which arises as a result of the weak point caused by the gap. It cannot completely preclude the risk of shooting through. In the case where the firing direction lies in a plane which corresponds to the main tendency of the gap course, the projectile experiences a considerably reduced resistance through the plates, which are, for the rest, designed in a bombardment-inhibiting manner. Furthermore, the known construction has the disadvantage that housebreaking (burglary) tools can be freely introduced into the gap to a considerably depth, and, with the aid of a striking tool, can be driven still deeper into the gap. In this respect a jemmy or crowbar, for example, encounters a reduced resistance if it is likewise introduced in the plane which corresponds to the main tendency of the gap course.

The object of the invention is to provide a door or window wherein the gap region between the fixed frame and the swingably-mounted sash frame arranged therein ensures, without additional expenditure, a higher degree of safety both against bombardment and against break-in than the known construction of this kind.

This object is achieved by provision of a door or a window of the kind mentioned in the introductory paragraph above, but characterized in that the bombardment-inhibiting profiles are mutually indented in the gap region in such a way that, in each case, a ridge integrally formed on the one profile lies opposite a groove which is formed into the other profile.

By indenting and intermeshing the bombardmentinhibiting profiles, in accordance with the invention, these profiles can be in alignment with one another on their attack-endangered side and nevertheless engage behind one another by means of the respective integrally-formed ridges and formed-in grooves. In this way there is a very resistant gap covering relative to the room that is to be protected. As a result of the mutual indenting, the gap does not extend in only one primary plane. Instead it is configured such that centre lines of gap partial regions intersect at angles of from about 0° up to about 180° and in parts extend parallel.

This gap course is conveniently achieved in a particularly simple manner if the ridges are convex and the grooves are concave in design. The centre line of the gap then extends likewise in convex and concave arcs, which merge into one another, so that a gap which is aligned by tendency primarily, in any one plane is avoided.

With regard to production-technology, the aforesaid development in accordance with the invention has the advantage that the blanks for the safety profiles can be produced with comparatively simple rolling tools.

For unimpeded operation of the sash frame with the smallest possible gap width between the sash frame and the fixed frame, the gap width in the region of the ridges and grooves is preferably less than in the remaining gap region.

Finally, the gap width outside the region of the ridges and grooves is preferably substantially constant. In this way, the total surface area of the gap cross-section can be minimised and the shoot-through and break-in inhibition be maximised.

With the construction in accordance with the invention a yielding movement of the profiles in the direction of the pane plane is limited to a minimum in the event of an attempt at break-in. Thus, the perpetrator has to undertake additional clawing of the profiles.

The invention will be described further, by way of example, with reference to the accompanying drawing in which the single FIGURE is a cross-section of one member of a fixed frame and one neighbouring member of a swingably-mounted sash frame for an exemplary embodiment of a door in accordance with the invention.

As illustrated in the drawing, the member 1 of the fixed frame consists of a box-section profile 2 and a substantially band-shaped profile 3 extending in the plane of the frame. These profiles 2, 3 are connected together by way of heat-insulating webs 4, which are arranged parallel at a spacing to one another and define a cavity 5.

Arranged at a spacing parallel to the member of the fixed frame is the member 6 of the swingable frame. This member 6 consists of two box-section profiles 7 and 8, which are likewise connected together by way of heat-insulating webs 9. Also the webs 9 are arranged at a spacing parallel to one another and define a cavity 10.

On the attack-endangered side of the door, a bombardment-inhibiting profile 11 which is rectangular in cross-section is fastened to the profile 3 of the fixed frame member 1, and a respective bombardment-inhibiting profile 12 which is Z-shaped in cross-section is fastened to the profile 8 of the swingable frame member 6. These respective profiles 11, 12 are so designed that their edge margins 11', 12' overlap with a gap 13 remaining there-between in the overlap region. This gap 13 is bounded by edge surfaces of the respective safety profiles 11 and 12, which surfaces are composed of arcuate regions which merge into one another. On each profile 11, 12 these surfaces define a respective ridge 14, 17 and a respective groove 15, 16.

A part 18 of the gap 13 is defined by edge surface regions 19, 20 of the bombardment-inhibiting profiles 11, 12 which extend at an angle of at least 90° to the plane of the door. This gap part 18 is wider in design than a gap part 21 linking thereto, in order to ensure unimpeded operation of the sash frame. However, the width of the gap part 21 can be reduced throughout almost to 0 when a degree of play for unimpeded sash frame operation is not necessary.

As a result of the overlap and the sinusoidal or labyrinth-shaped course of the gap 13, the safety against shoot-through and break-in, which is reduced in the region of conventionally-designed gaps, is considerably improved.

I claim:

1. A door or window having a fixed frame and a swingably mounted sash frame arranged therein, the front surface of said fixed and swingable frames being defined by a complemental and generally planar fixed frame profile and a sash frame profile covering the faces of said fixed and sash frames respectively, a safety pane mounted in said sash frame, the edge regions of said safety pane being masked by bombardment-inhibiting portions of said sash profile, other portions of said sash profile overlapping bombardment-inhibiting portions of said fixed frame profile, said profiles together defining a gap therebetween in the overlap region, said gap defining a sinuous path running generally in the direction of said pane and changing its direction more than once in a plane perpendicular to the plane of said pane, said sash profile and fixed frame profile being mutually indented in said gap region such that, in each case, a ridge integrally formed on each said profile lies within a groove formed into the other said profile, the outermost edge portions of said sash frame profile being outwardly lapped by portions of said fixed frame profile.

2. A door or window as claimed in claim 1, characterised in that the ridges are convex and the grooves are concave in design.

3. A door or window as claimed in claim 1, characterised in that the gap width in the region of the ridges and grooves is less than in the remaining gap region.

4. A door or window as claimed in claim 1, characterised in that the width of the gap in the region remaining outside the region of the ridges and grooves is substantially constant.

* * * * *